US010455649B2

(12) United States Patent
Viroli et al.

(10) Patent No.: US 10,455,649 B2
(45) Date of Patent: Oct. 22, 2019

(54) INDUCTION COIL ASSEMBLY AND INDUCTION HOB COMPRISING AN INDUCTION COIL ASSEMBLY

(71) Applicant: Electrolux Appliances Aktiebolag, Stockholm (SE)

(72) Inventors: Alex Viroli, Forli (IT); Filippo Milanesi, Forli (IT); Ulrich Häutle, Rothenburg ob der Tauber (DE); Bernd Glänzer, Rothenburg ob der Tauber (DE); Uwe Kallert, Rothenburg ob der Tauber (DE)

(73) Assignee: Electrolux Appliances Aktiebolag, Stockholm (SE)

( * ) Notice: Subject to any disclaimer, the term of this patent is extended or adjusted under 35 U.S.C. 154(b) by 90 days.

(21) Appl. No.: 15/129,038

(22) PCT Filed: May 12, 2015

(86) PCT No.: PCT/EP2015/060426
§ 371 (c)(1),
(2) Date: Sep. 26, 2016

(87) PCT Pub. No.: WO2015/180956
PCT Pub. Date: Dec. 3, 2015

(65) Prior Publication Data

US 2017/0105251 A1 Apr. 13, 2017

(30) Foreign Application Priority Data

May 26, 2014 (EP) ..... 14169776

(51) Int. Cl.
*H05B 6/12* (2006.01)
*H05B 6/36* (2006.01)

(52) U.S. Cl.
CPC ..... *H05B 6/1209* (2013.01); *H05B 2206/022* (2013.01)

(58) Field of Classification Search
CPC .. H05B 6/1209; H05B 6/1245; H05B 6/1254; H05B 6/1263; H05B 6/44; H05B 2206/022

(Continued)

(56) References Cited

U.S. PATENT DOCUMENTS 3,443,064 A 5/1969 Meng et al.
4,910,372 A * 3/1990 Vukich ..... H05B 6/1209 219/624

(Continued)

FOREIGN PATENT DOCUMENTS

DE 202004012712 U1 * 12/2005 ..... H01R 4/4818
DE 102012101829 A1 9/2013

(Continued)

OTHER PUBLICATIONS

International Search Report & Written Opinion issued in PCT/EP2015/060426 dated Jul. 21, 2015, 9 pages.

*Primary Examiner* — Hung D Nguyen
(74) *Attorney, Agent, or Firm* — Pearne & Gordon LLP

(57) ABSTRACT

The invention relates to an induction coil assembly for an induction hob comprising: a coil baseplate (2) adapted to receive an induction coil (3); an adapter assembly (4) being mechanically coupled with the coil baseplate (2) via a connecting portion (5); wherein the adapter assembly (4) being adapted to be mounted at an electronic power board (6) of the induction hob and wherein the adapter assembly (4) comprises electrical connecting means for realizing a first electrical connection between the induction coil (3) and the electronic power board (6) and further electrical connecting means for realizing a second electrical connection (Continued)

between an induction coil sensor and the electronic power board (6).

15 Claims, 3 Drawing Sheets

(58) Field of Classification Search
USPC ..... 219/460.1–468.2, 620, 622, 624, 661, 219/672, 675, 676
See application file for complete search history.

(56) References Cited

U.S. PATENT DOCUMENTS

| | | | | |
|---|---|---|---|---|
| 5,092,790 | A | 3/1992 | Justiano et al. | |
| 2008/0302782 | A1* | 12/2008 | Cho | H05B 6/1245 219/448.17 |
| 2010/0206871 | A1* | 8/2010 | Kataoka | H05B 6/062 219/622 |

FOREIGN PATENT DOCUMENTS

| | | | |
|---|---|---|---|
| JP | 2004-31160 | A * | 1/2004 |
| JP | 2004031160 | A | 1/2004 |

* cited by examiner

FIG 5
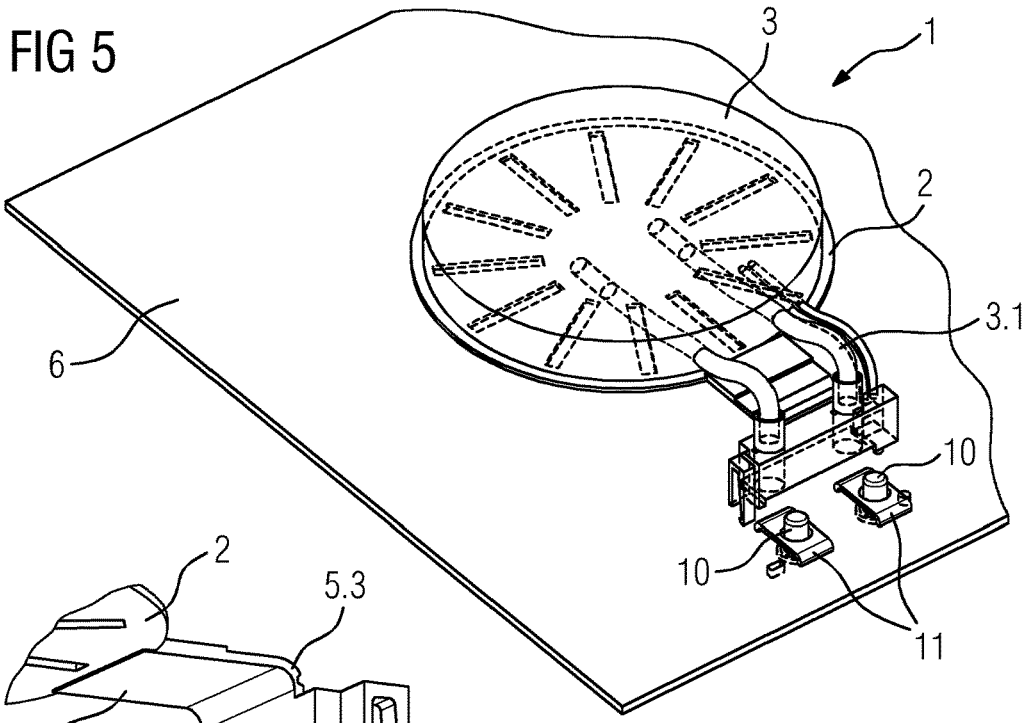
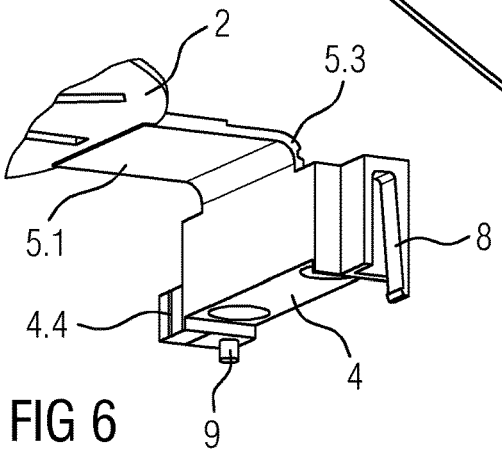
FIG 6
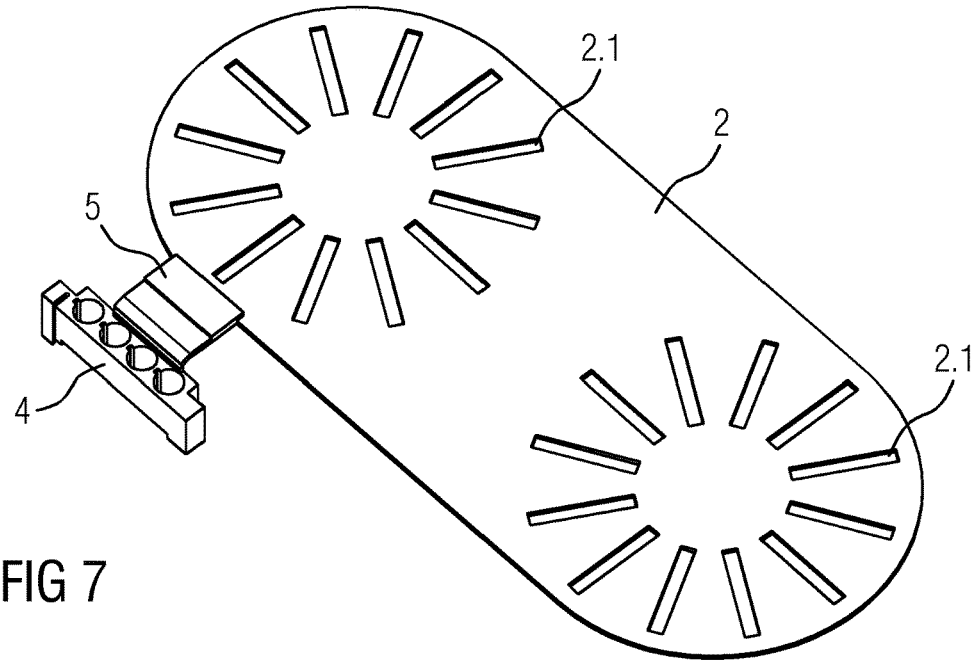
FIG 7

INDUCTION COIL ASSEMBLY AND INDUCTION HOB COMPRISING AN INDUCTION COIL ASSEMBLY

Generally, the present invention relates to the field of induction hobs. More specifically, the present invention is related to an induction coil assembly for use in an induction hob.

BACKGROUND OF THE INVENTION

Induction hobs for preparing food are well known in prior art. Induction hobs typically comprise at least one induction heater which is associated with at least one induction coil. For heating a piece of cookware placed on the induction hob, the induction coil is coupled with an electronic power board for providing electrical power to the induction coil.

Typically, the induction coil comprises induction coil cables which have to be manually attached to the electronic power board in the assembly process. In addition, the induction coil comprises a sensor which also has to be coupled manually with the electronic power board during the assembly process. So, for an induction hob comprising four induction coils, twelve electrical connections have to be established, which is time-consuming and cost-intensive.

SUMMARY OF THE INVENTION

It is an objective of the embodiments of the invention to provide an induction coil assembly which enables a mechanically simple, time-efficient and cost-efficient assembling of an induction hob. The objective is solved by the features of the independent claims. Preferred embodiments are given in the dependent claims. If not explicitly indicated otherwise, embodiments of the invention can be freely combined with each other.

According to an aspect of the invention, the invention relates to an induction coil assembly for an induction hob. The induction coil assembly comprises:

a coil baseplate adapted to receive an induction coil;

an adapter assembly being mechanically coupled with the coil baseplate via a connecting portion;

wherein the adapter assembly is adapted to be mounted at an electronic power board of the induction hob and wherein the adapter assembly comprises electrical connecting means for realizing a first electrical connection between the induction coil and the electronic power board and further electrical connecting means for realizing a second electrical connection between an induction coil sensor and the electronic power board.

The first electrical connection between the electronic power board and the electrical connection means provided in the adapter assembly may be established while the adapter assembly is attached to the electronic power board. For example, the adapter assembly may comprise contacts for receiving corresponding contacts of a cable of the induction coil. Said contacts of the adapter assembly may be electrical connected to electrical contacts provided at the electronic power board while mounting the adapter assembly to the electronic power board. In addition, the second electrical connection may also be realized by mounting the adapter assembly to the electronic power board. By means of the induction coil assembly, the assembling procedure of the induction hob is essentially simplified.

According to preferred embodiments, the adapter assembly comprises a single electrical connector, the electrical connector being configured to receive a corresponding electrical connector of an induction coil cable or the adapter assembly comprises at least two electrical connectors, wherein each electrical connector is configured to receive a corresponding electrical connector of an induction coil cable. The electrical connectors provided in the adapter assembly may be, for example, crimp contacts. The electrical connectors provided in the adapter assembly may be electrically coupled with electrical contacts of the electronic power board. Said electrical coupling may be established when mounting the adapter assembly to the electronic power board. Thereby, the adapter assembly provides at least one electrical port for receiving at least one free end of the induction coil cable in order to provide electrical power to the induction coil.

According to embodiments, the at least one electrical connector is arranged in a recess of the adapter assembly. For example, the adapter assembly may comprise bores at the upper side, in which the electrical connectors are embedded. Thereby, the corresponding connectors provided at the induction cable can be plugged in said bores in order to establish an electrical connection with the electronic power board. Alternatively or additionally, the electrical connector may be arranged in a recess located at a corner of the adapter assembly.

According to embodiments, the adapter assembly comprises at least one electrical connector configured to receive a corresponding electrical connector of an induction coil sensor cable. Typically, the induction coil comprises a sensor for controlling the operation of the induction coil. The sensor is electrically connected with the electronic power board via an induction coil sensor cable. Advantageously, the adapter assembly provides also the electrical connector for realizing an electrical coupling of the induction coil sensor cable with the electronic power board.

Thereby, the adapter assembly also provides an interface for the induction coil sensor which additionally simplifies the assembling process.

According to embodiments, the electrical connector is a plug-in contact or a crimp contact. Thereby, the establishing of the electrical contact between the induction coil and the electrical power board is simplified.

According to embodiments, the connecting portion comprises a plate-like shape. Said connecting portion provides a bridge-like coupling of the coil baseplate and the adapter assembly. The connecting portion and the coil baseplate may be constituted by a single-piece element.

According to embodiments, the connecting portion comprises two sub-portions being coupled via a hinge portion. For example, the hinge portion may comprise a film hinge. By means of the hinge portion it is possible to flex the connecting portion. Specifically, it is possible to bring the connecting portion in a bracket-like shape or a planar shape, in which the first and second sub-portions lie in the same plane. Thereby, the packing volume of the induction coil assembly can be significantly reduced.

According to embodiments, the adapter assembly is configured to be screwed at the electronic power board. Preferably, the adapter assembly is screwed at the electronic power board by means of screws, wherein the screws are inserted from the lower surface of the electronic power board into the adapter assembly provided at the upper surface of the electronic power board. Said screws may also establish the electrical connection between the electrical contacts of the electronic power board and electrical contacts provided at or in the adapter assembly. In other words, the screws provides for the mechanical and electrical coupling of the adapter assembly to the electronic power board.

According to embodiments, the adapter assembly comprises fixing means for pre-fixing the adapter assembly to the electronic power board. Thereby, it is possible to snap the adapter assembly at the electronic power board in a first step in order to mount the adapter assembly in a following, second step, e.g. by a screwing process.

According to embodiments, the fixing means comprise at least one snap-fit element. Said snap-fit element may interact with corresponding openings or recesses at the electronic power board in order to provide a snap-fit coupling between the electronic power board and the adapter assembly.

According to embodiments, the coil baseplate is adapted to receive two or more induction coils, wherein a single adapter assembly is provided comprising electrical connecting means for realizing electrical connections between each induction coil and the electronic power board and further electrical connecting means for realizing electrical connections between the induction coil sensors and the electronic power board. Thereby, at least two induction coils can be electrically coupled with the electronic power board via a single adapter assembly.

According to a further aspect, the invention refers to an induction hob. Said induction hob comprises an induction coil assembly with a coil baseplate, an induction coil and an electronic power board for powering the induction coil. The induction coil assembly is configured according to the embodiments described above.

According to embodiments, the adapter assembly is mounted to the electronic power board by means of at least one screw, wherein the screws are screwed from the bottom side of the electronic power board into the adapter assembly.

According to embodiments, the adapter assembly protrudes at the upper side of the electronic power board and the connecting portion and the coil baseplate protrudes laterally from the adapter assembly at the upper portion of the adapter assembly. Thereby, the induction coil is located at a distance to the electronic power board.

The terms "essentially", "substantially" or "approximately" as used in the invention means deviations from the exact value by +/−10%, preferably by +/−5% and/or deviations in the form of changes that are insignificant for the function.

BRIEF DESCRIPTION OF THE DRAWINGS

The various aspects of the invention, including its particular features and advantages, will be readily understood from the following detailed description and the accompanying drawings, in which:

FIG. 5 shows an exemplary attachment of the induction coil assembly at an electronic power board according to a second embodiment;

FIG. 6 shows a sectional perspective view of the induction coil assembly from the bottom side; and FIG. 7 shows an example schematic view of an induction coil assembly according to a second embodiment.

DETAILED DESCRIPTION OF PREFERRED EMBODIMENTS

Figure 1:
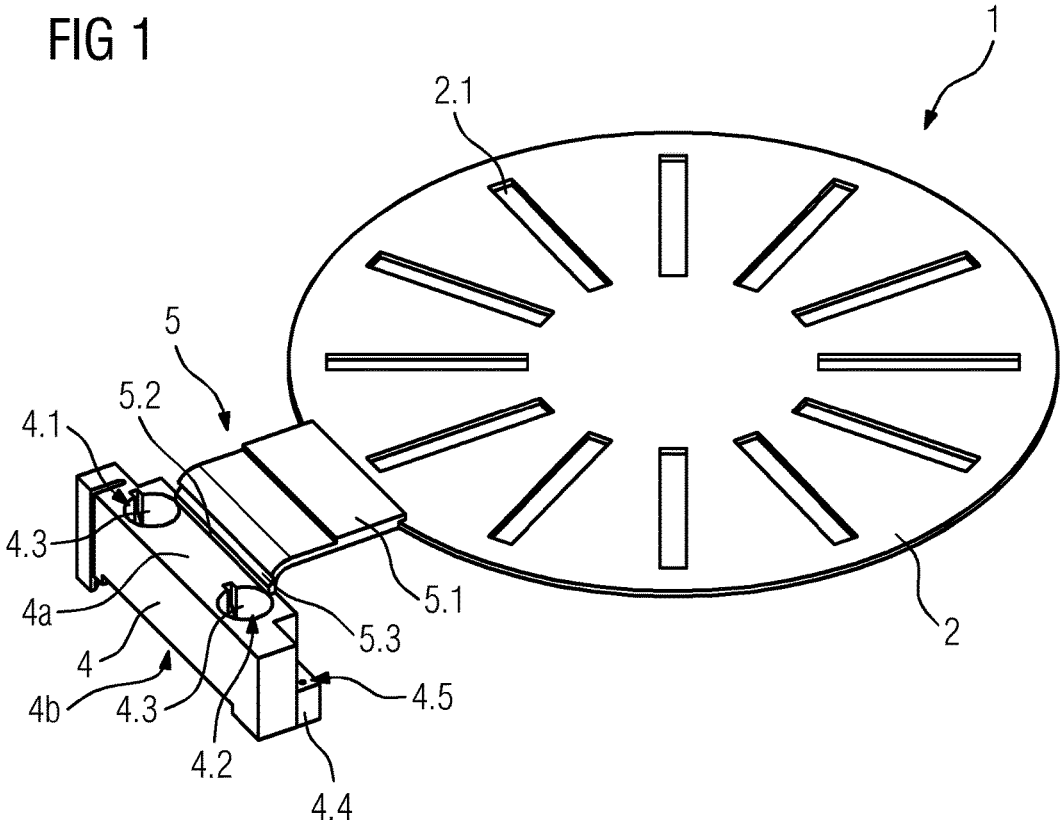
FIG. 1 shows an example schematic view of an induction coil assembly according to a first embodiment.

The present invention will now be described more fully with reference to the accompanying drawings, in which example embodiments are shown. However, this invention should not be construed as limited to the embodiments set forth herein. Throughout the following description similar reference numerals have been used to denote similar elements, parts, items or features, when applicable.

Figure 2:
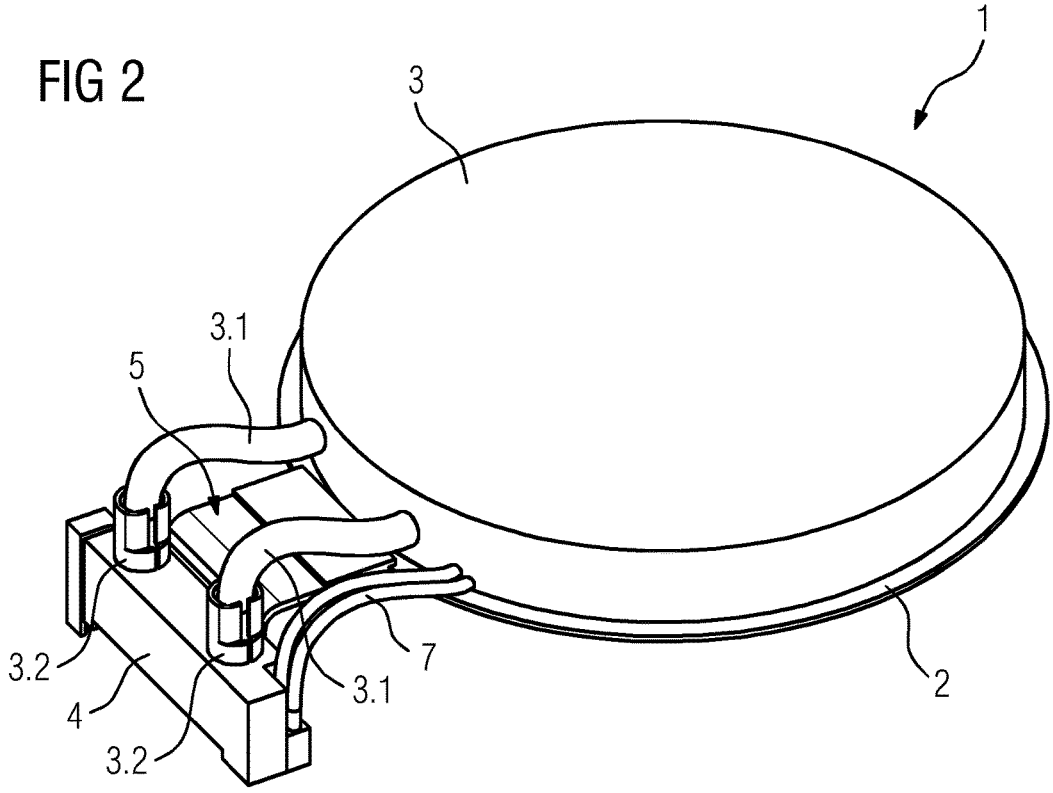
FIG. 2 shows an example schematic view of the induction coil assembly of FIG. 1 with an induction coil.
Figure 3:
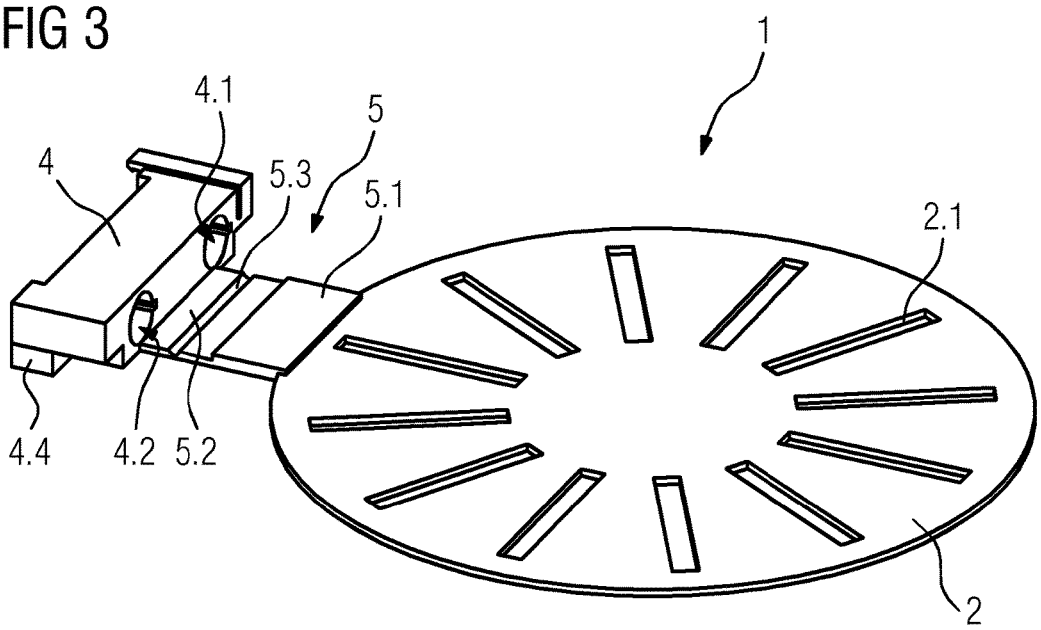
FIG. 3 shows an example schematic view of the induction coil assembly according to FIG. 1 in a packaging-optimized state.

FIGS. 1 to 3 show an induction coil assembly 1 according to a first embodiment. The induction coil assembly 1 comprises a coil baseplate 2. Said coil baseplate 2 is adapted to receive an induction coil 3, i.e. the induction coil 3 may supported by the coil baseplate 2. For example, the coil baseplate 2 may comprise a planar shape and may be adapted to the shape and dimensions of the induction coil 3. Furthermore, the coil baseplate 2 may comprise a plurality of apertures 2.1, e.g. apertures 2.1 arranged in a star-shaped manner. The coil baseplate 2 may be made of plastic or metal, e.g. aluminium.

The induction coil assembly 1 further comprises an adapter assembly 4. The adapter assembly 4 serves as mechanical connection means between the coil baseplate 2 and an electronic power board 6. Said electronic power board 6 is adapted to provide electric power to the induction coil 3. The adapter assembly 4 may be mechanically coupled with the coil baseplate 2 by means of a connecting portion 5.

Besides providing the mechanical connection between the coil baseplate 2 and the electronic power board 6, the adapter assembly 4 provides electrical connection means for electrically coupling the induction coil 3 with the electronic power board 6. Said electrical connection means may be electrical connectors 4.1, 4.2 or contacts provided at or in the adapter assembly 4, said electrical connectors 4.1 or contacts being adapted to be coupled with corresponding electrical connectors 3.2 provided at the induction coil cable 3.1. In addition, the adapter assembly 4 may comprise further electrical connection means for electrically coupling a sensor provided at or in the induction coil 3 with the electronic power board 6.

As shown in FIGS. 1 and 2, the adapter assembly 4 substantially comprises a cuboid-like shape with an upper surface 4*a* and a lower surface 4*b*. The lower surface 4*b* may be adapted to be arranged at the electronic power board 6, whereas the upper surface 4*a* being opposite to the lower surface 4*b* comprises at least one, in the current example two recesses 4.3, in which the electrical connectors 4.1, 4.2 are provided. Said recesses 4.3 may be adapted to receive corresponding electrical connectors 3.2 of the induction coil cable 3.1. In addition, the adapter assembly 4 comprises a further recess 4.5, for example, a lateral recess, in which an electrical connector 4.4 is provided. Said electrical connector 4.4 is adapted to receive a corresponding electrical connector of an induction coil sensor cable 7. The electrical connector 4.4 may be electrically coupled with the electronic power board 6 for realizing an electrical connection between the sensor provided at or in the induction coil 3 and the electronic power board 6. The electrically connectors 4.1, 4.2 and 4.4 may be, for example, plug-in connectors.

As already mentioned above, the coil baseplate 2 is mechanically coupled with the adapter assembly 4 by means of the connecting portion 5. The connecting portion 5 comprises essentially a planar shape, wherein a first end of the connecting portion 5 is arranged at the coil baseplate 2 and a second end of the connecting portion 5 is arranged at the adapter assembly. Thereby, a bridge-like mechanical coupling between the coil baseplate 2 and the adapter assembly 4 is obtained. According to an embodiment, the connecting portion 5 comprises a first and a second sub-portion 5.1, 5.2 and a hinge portion 5.3 between said first and second sub-portion 5.1, 5.2. As shown in FIG. 3, by means of said hinge portion 5.3 it is possible to flex said connecting portion 5 such that the first and second sub-portion lie in the same plane. Thereby, the packing volume of the induction coil assembly 1 is the reduced. When installing the induction coil assembly 1 at the electronic power board 6, the connecting portion 5 may be flexed in order to obtain a bracket-like connecting portion 5 (as shown in FIGS. 1 and 2).

The induction coil assembly 1 may comprise at least two assembly components which are adapted to be arranged at each other in order to form the induction coil assembly 1. For example, the coil baseplate 2 and the connecting portion 5 may be formed as one piece and the adapter assembly 4 may be mounted as a removable part at the connecting portion 5. The coil baseplate 2 and the connecting portion 5 may be made of plastics or metal, for example aluminium. The adapter assembly 4 may be made of plastics. According to another embodiment, the induction coil assembly 1 may be a one-piece part, i.e. the adapter assembly 4, the connecting portion 5 and the coil baseplate 2 may be integrally formed.

Figure 4:
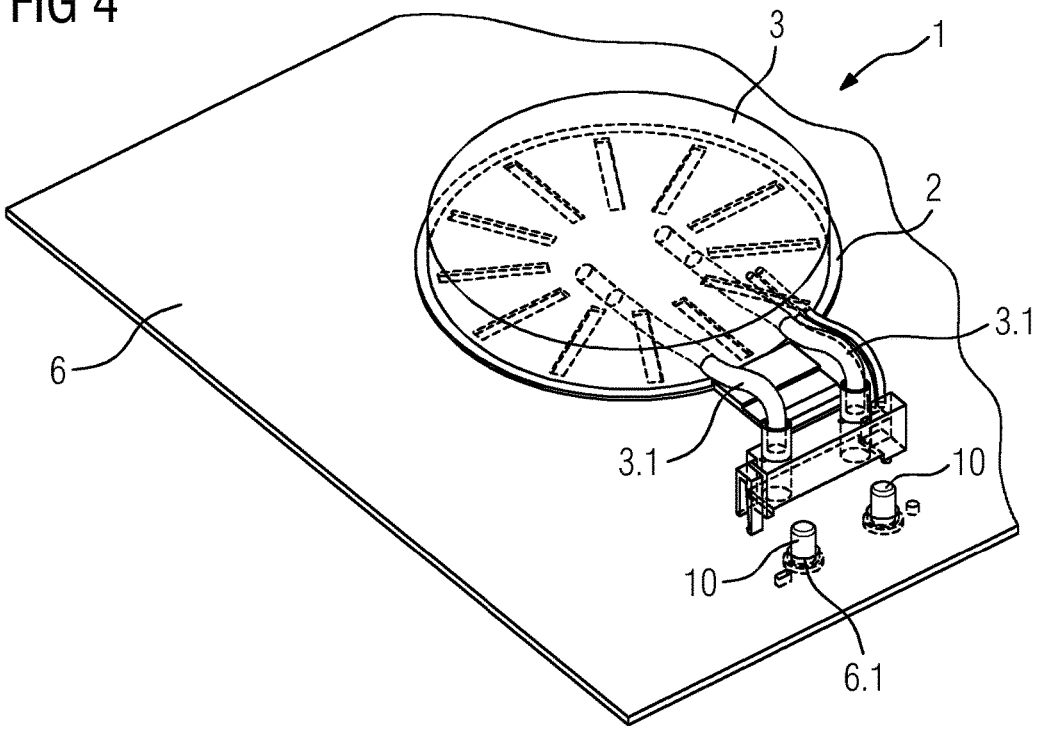
FIG. 4 shows an exemplary attachment of the induction coil assembly at an electronic power board according to a first embodiment.

FIGS. 4 and 5 show different ways of mounting the induction coil assembly 1 to the electronic power board 6. According to FIG. 4, the electronic power board 6 comprise at least one, according to the present example two bores 6.1 for receiving screws 10 which are screwed in the adapter assembly 4. Preferably, said screws 10 may be screwed from the lower side of the electronic power board 6 through said electronic power board 6 into the adapter assembly 4. In case that the induction coil assembly 1 is adapted to receive a high power induction coil 2, connectors or brackets 11 may be mounted at the electronic power board 6. The screws 10 may be screwed through the electronic power board 6 and said connectors or brackets 11 in order to obtain a robust connection between the electronic power board 6 and the adapter assembly 4.

FIG. 6 shows a sectional view of the induction coil assembly 1 in a perspective view from the bottom side. For pre-fixing the induction coil assembly 1 at the electronic power board 6, the induction coil assembly 1 comprises fixing means 8, 9 for pre-attaching the induction coil assembly 1 at the electronic power board 6. Said fixing means 8, 9 may be bolts, latching elements or snap fitting elements which are adapted to be snapped into apertures of the electronic power board 6. After prefixing, the final attachment may be obtained by the upper-mentioned screw connection. The fixing means 8, 9 may be provided at the adapter assembly 4 or and the connecting portion 5, specifically at the second sub-portion 5.2 of the connecting portion 5.

In FIG. 7, a further embodiment of the induction coil assembly 1 is shown. The induction coil assembly 1 comprise a coil baseplate 2 for receiving multiple induction coils 3, e.g. a pair of induction coils 3. For example, the coil baseplate 2 may comprise oval shape. The induction coil assembly 1 may comprise one or more connecting portions 5 for coupling the coil baseplate 2 with one or more adapter assemblies 4. According to the present embodiment, the coil baseplate 2 may comprise a single connecting portion 5 and a single adapter assembly 4. The adapter assembly 4 may comprise electrical connectors 4.1, 4.2 for providing electrical contacts for the induction coils 3 which are arranged at the single coil baseplate 2. For example, the adapter assembly 4 may comprise four electrical connectors 4.1, 4.2 for receiving corresponding electrical connectors provided at the induction coil cables of the induction coils 3. In addition, the adapter assembly 4 may provide electrical connectors for each sensor provided at or in the induction coils 3 to be received at the coil baseplate 2. For example, the adapter assembly 4 may comprise two electrical connectors for receiving corresponding electrical connectors of the induction coil sensor cable 7.

Above, embodiments of an induction coil assembly according to the present invention as defined in the appended claims have been described. These should be seen as merely non-limiting examples. As understood by a skilled person, many modifications and alternative embodiments are possible within the scope of the invention.

LIST OF REFERENCE NUMERALS

1 Induction coil assembly
2 coil baseplate
2.1 aperture
3 induction coil
3.1 induction coil cable
3.2 electrical connector
4 adapter assembly
**4*a*** upper surface
**4*b*** lower surface
4.1, 4.2 electrical connector
4.3 recess
4.4 electrical connector
4.5 recess
5 connecting portion
5.1 first sub-portion
5.2 second sub-portion
5.3 hinge portion
6 electronic power board
6.1 bore
7 induction coil sensor cable
8, 9 fixing means
10 screw
11 bracket

The invention claimed is:

1. An induction coil assembly for an induction hob comprising:

a coil baseplate adapted to receive an induction coil;

an adapter assembly being mechanically coupled with the coil baseplate via a connecting portion;

the adapter assembly being adapted to be mounted at an electronic power board of the induction hob, the adapter assembly comprising electrical connecting means for realizing a first electrical connection between the induction coil and the electronic power board and further electrical connecting means for realizing a second electrical connection between an induction coil sensor and the electronic power board.

2. The induction coil assembly according to claim 1, wherein the adapter assembly comprises a single electrical connector, the electrical connector being configured to receive a corresponding electrical connector of an induction coil cable or the adapter assembly comprises at least two electrical connectors, wherein each electrical connector is configured to receive a corresponding electrical connector of an induction coil cable.

3. The induction coil assembly according to claim 2, wherein the at least one electrical connector is arranged in a recess of the adapter assembly.

4. The induction coil assembly according to claim 2, wherein the electrical connector is a plug-in contact or a crimp contact.

5. The induction coil assembly according to claim 1, wherein the adapter assembly comprises at least one electrical connector configured to receive a corresponding electrical connector of an induction coil sensor cable.

6. The induction coil assembly according to claim 1, wherein the connecting portion comprises a plate-like shape.

7. The induction coil assembly according to claim 1, wherein the connecting portion comprises a first sub-portion coupled to said base plate and a second sub-portion coupled to said adapter assembly, said first and second sub-portions being coupled to one another via a hinge portion.

8. The induction coil assembly according to claim 7, wherein the hinge portion comprises a film hinge.

9. The induction coil assembly according to claim 1, wherein the adapter assembly is configured to be screwed to the electronic power board.

10. The induction coil assembly according to claim 1, wherein the adapter assembly comprises fixing means for pre-fixing the adapter assembly to the electronic power board.

11. The induction coil assembly according to claim 10, wherein the fixing means comprise at least one snap-fit element.

12. The induction coil assembly according to claim 1, wherein the coil baseplate is adapted to receive two or more induction coils, wherein a single adapter assembly is provided comprising electrical connecting means for realizing electrical connections between each induction coil and the electronic power board and further electrical connecting means for realizing electrical connections between the induction coil sensors and the electronic power board (6).

13. An induction hob comprising an induction coil assembly comprising:

a coil baseplate adapted to receive an induction coil;

an adapter assembly being mechanically coupled with the coil baseplate via a connecting portion;

the adapter assembly being adapted to be mounted at an electronic power board of the induction hob, the adapter assembly comprising electrical connecting means for realizing a first electrical connection between the induction coil and the electronic power board and further electrical connecting means for realizing a second electrical connection between an induction coil sensor and the electronic power board, and the electronic power board for powering the induction coil.

14. The induction hob according to claim 13, wherein the adapter assembly is mounted to the electronic power board by means of at least one screw, wherein the at least one screw is screwed from the bottom side of the electronic power board into the adapter assembly.

15. The induction hob according to claim 13, wherein the adapter assembly protrudes at the upper side of the electronic power board and the connecting portion and the coil baseplate protrudes laterally from the adapter assembly at the upper portion of the adapter assembly.

* * * * *